US008347790B1

(12) United States Patent
Maiers

(10) Patent No.: US 8,347,790 B1
(45) Date of Patent: Jan. 8, 2013

(54) MULTI-PURPOSE TABLE

(76) Inventor: Russell J. Maiers, Colorado Springs, CO (US)

( * ) Notice: Subject to any disclaimer, the term of this patent is extended or adjusted under 35 U.S.C. 154(b) by 0 days.

(21) Appl. No.: 13/443,037

(22) Filed: Apr. 10, 2012

Related U.S. Application Data

(63) Continuation-in-part of application No. 12/843,191, filed on Jul. 26, 2010, now abandoned.

(51) Int. Cl.
*A47B 85/00* (2006.01)

(52) U.S. Cl. ..... 108/26; 108/25

(58) Field of Classification Search ..... 108/25, 108/26, 35, 36, 38, 162, 167, 169, 170, 171, 108/172, 168, 173, 174, 175, 177, 115; 275/284, 275/287, 286
See application file for complete search history.

(56) References Cited

U.S. PATENT DOCUMENTS

| | | | | | |
|---|---|---|---|---|---|
| 1,838,558 | A | * | 12/1931 | Kolodny | 108/26 |
| 1,979,301 | A | * | 11/1934 | Webb | 108/26 |
| 2,008,078 | A | * | 7/1935 | Martin | 108/26 |
| 2,171,772 | A | * | 9/1939 | Viehmann | 108/26 |
| 2,358,883 | A | * | 9/1944 | Rothschild | 108/35 |
| 2,680,666 | A | * | 6/1954 | Orlando | 108/26 |
| 2,754,167 | A | * | 7/1956 | Young | 108/26 |
| 2,827,352 | A | * | 3/1958 | Boyajian | 108/35 |
| 3,828,695 | A | * | 8/1974 | Skarky | 108/26 |
| 5,720,226 | A | * | 2/1998 | Padovano | 108/25 |
| 5,778,800 | A | * | 7/1998 | Liang | 108/50.11 |
| 5,915,804 | A | * | 6/1999 | Crescenzo | 108/26 |
| 6,321,662 | B1 | * | 11/2001 | Fraise | 108/25 |
| D539,579 | S | | 4/2007 | Elko | |
| 7,387,299 | B1 | | 6/2008 | Voden | |

* cited by examiner

*Primary Examiner* — Jose V Chen

(57) ABSTRACT

A multi-purpose table including aperture disposed in a top surface and removable cups therein for playing a bean bag game and for holding items therein, respectively; a pair of compartments underneath the table surface for holding bean bags; and a plurality of spaced apart drawers having holes in which to hold cups and slots for holding poker chips.

3 Claims, 6 Drawing Sheets

MULTI-PURPOSE TABLE

CROSS-REFERENCE TO RELATED APPLICATIONS

U.S. patent application Ser. No. 12/843,191 Filed Jul. 26, 2010

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of tables are known in the prior art. However, what is needed is a table which includes apertures and removable cups therein for playing a bean bag game and for holding items therein, respectively; a pair of compartments underneath the table surface for holding bean bags; and a plurality of spaced apart drawers having holes in which to hold cups and slots for holding poker chips.

FIELD OF THE INVENTION

The present invention relates to tables, and more particularly, to a multi-purpose table.

SUMMARY OF THE INVENTION

The general purpose of the present multi-purpose table, described subsequently in greater detail, is to provide a multi-purpose table which has many novel features that result in a multi-purpose table which is not anticipated, rendered obvious, suggested, or even implied by prior art, either alone or in combination thereof.

To accomplish this, the present multi-purpose table 10 is a coffee table that accommodates various games, including poker and bean bag toss games. The multi-purpose table includes a table having a first half and a second half. Each of the first half and the second half have inner edges that continuously separably adjoin. A circular aperture, having a ledge continuously disposed along a bottom edge of a sidewall thereof, is disposed proximal to the outer edge of each of the first half and the second half. A semi-circular notch is disposed on an upper perimeter of each aperture and is sized to removably receive a finger therethrough. A cup, having an upper edge, is removably secured within each aperture. The upper edge is removably disposed atop the ledge this preventing the cup from falling through the aperture. The notch allows a user to lift the cup from the aperture. A disc-shaped cover removably entirely covers a first internal cavity of each cup. The cup may hold various items such as a television remote control, a pen, or bean bags.

A plurality of pull-out drawers is slidingly disposed on the bottom surface of each of the table first half and the table second half. A pair of circular holes is disposed through each drawer proximal to a front edge of the drawer to hold a cup therein. A plurality of horizontally aligned slots is disposed within each drawer for holding poker chips. The slots may be configured in three rows as shown to hold a sufficient number of poker chips and to organize the poker chips by denomination.

A compartment is centrally disposed on the bottom surface of each of the table first half and second half. Each compartment has a second cavity therethrough, which terminates at an inside edge of each compartment. Each compartment is sized to hold at least four bean bag toss game bean bags, thus allowing users to store enough bean bags for properly playing a bean bag toss game.

A pair of parallel U-shaped support members is continuously centrally disposed along a central horizontal axis of the bottom surface to support both the table first half and the table second half. Each of the support members have a pinhole system that removably conjoins the first half and the second half of the table. A leg is attached to the bottom surface at each corner of the table.

The table has a width of approximately 24 inches, a total length of approximately 70 inches, and a total height of approximately 17 inches. Each of the apertures has a diameter of approximately 6 inches. Each of the drawers has a length of approximately 6.5 inches and a width of approximately 6.5 inches. Each leg has a length of approximately 16 inches. Each of the U-shaped support members has a length of approximately 12 inches, a width of approximately 6 inches and height of approximately 3 inches. Each of the compartments has a length of approximately 10 inches, a width of approximately 8 inches and a height of approximately 6 inches. The foregoing dimensions support proper use of the apparatus as a coffee table which is used for playing the games mentioned herein. Thus, a user save a considerable amount of money over the cost of a separate coffee table, poker table, and bean bag toss table. Thus has been broadly outlined the more important features of the present multi-purpose table so that the detailed description thereof that follows may be better understood and in order that the present contribution to the art may be better appreciated.

Numerous objects, features and advantages of the present multi-purpose table will be readily apparent to those of ordinary skill in the art upon reading the following detailed description of presently preferred, but nonetheless illustrative, examples of the present multi-purpose table when taken in conjunction with the accompanying drawings. In this respect, before explaining the current examples of the present multi-purpose table in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the multi-purpose table. It is therefore important that the claims be regarded as including such equivalent constructions insofar as they do not depart from the spirit and scope of the present invention.

Objects of the present multi-purpose table, along with various novel features that characterize the invention are particularly pointed out in the claims forming a part of this disclosure. For better understanding of the multi-purpose table, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
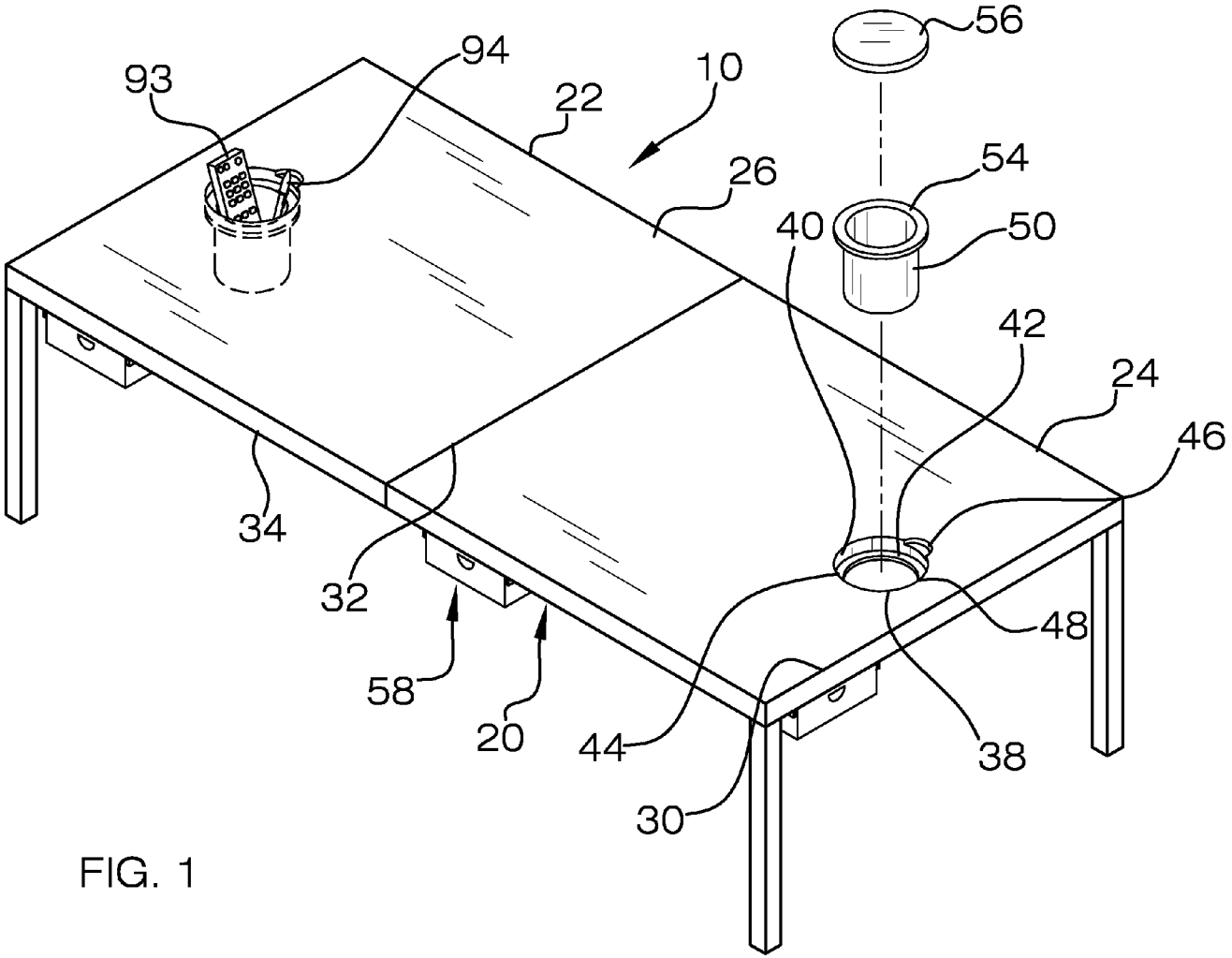
FIG. 1 is an isometric top view.
Figure 2:
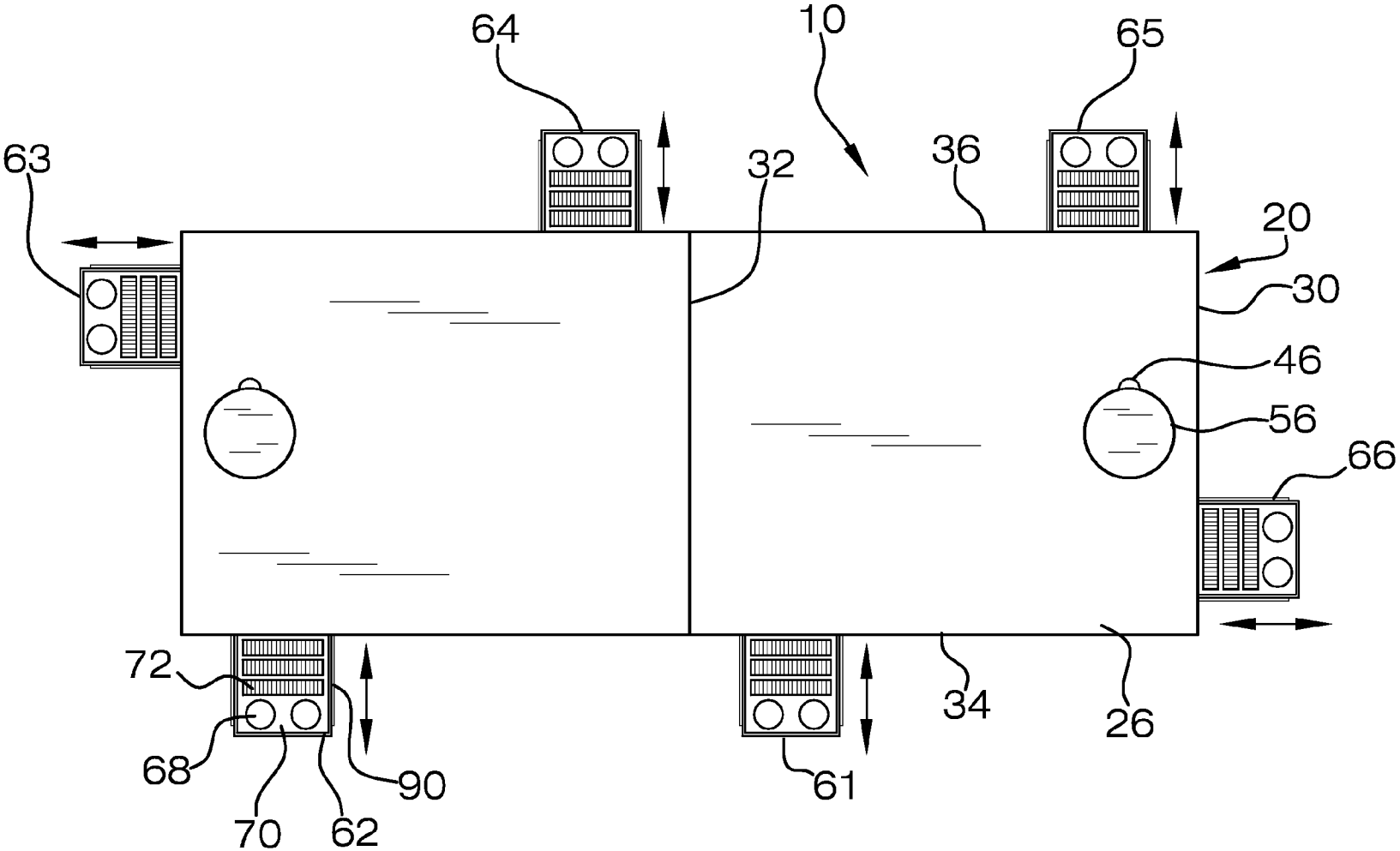
FIG. 2 is a top plan view.
Figure 3:
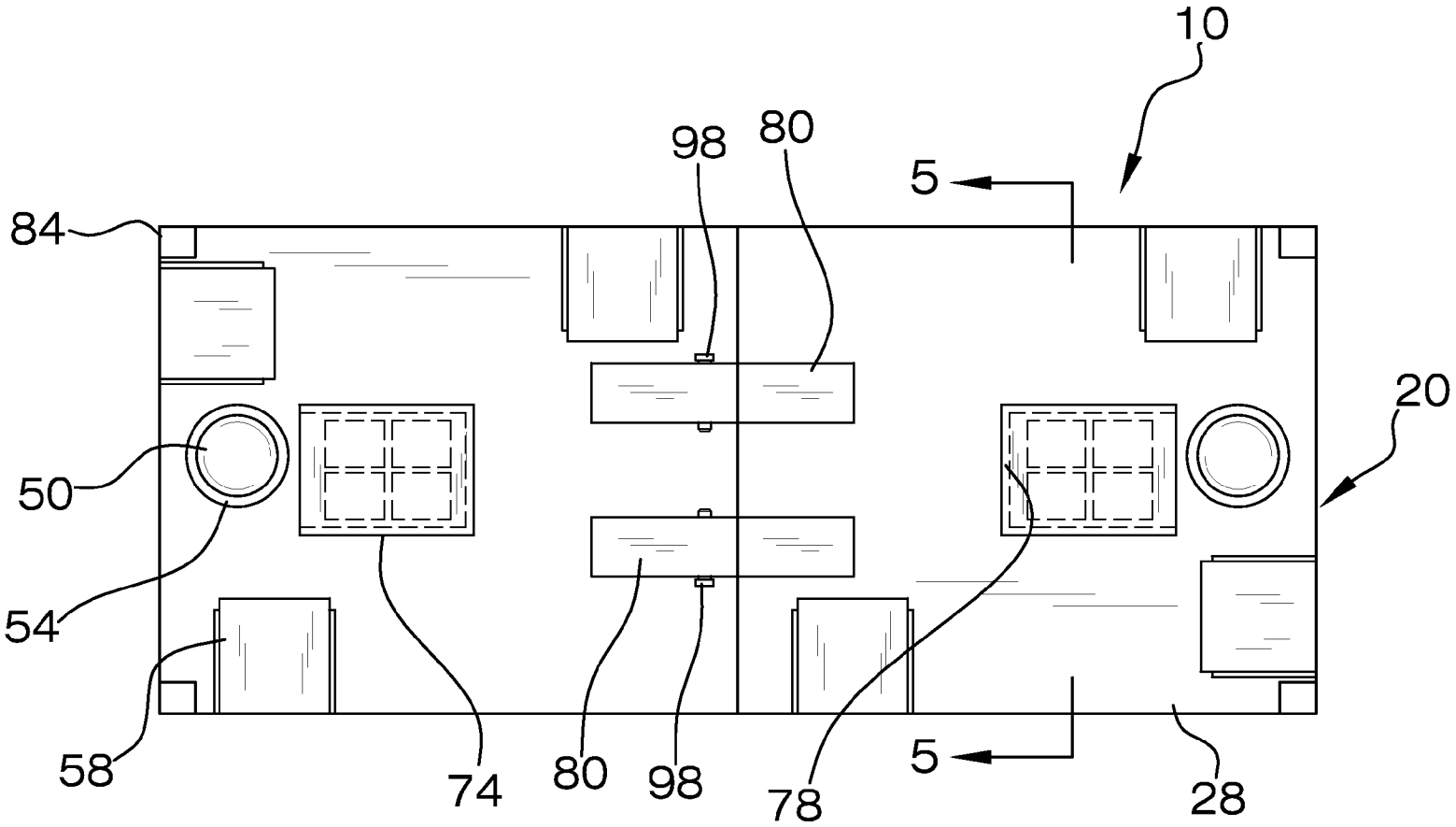
FIG. 3 is a bottom plan view.
Figure 4:
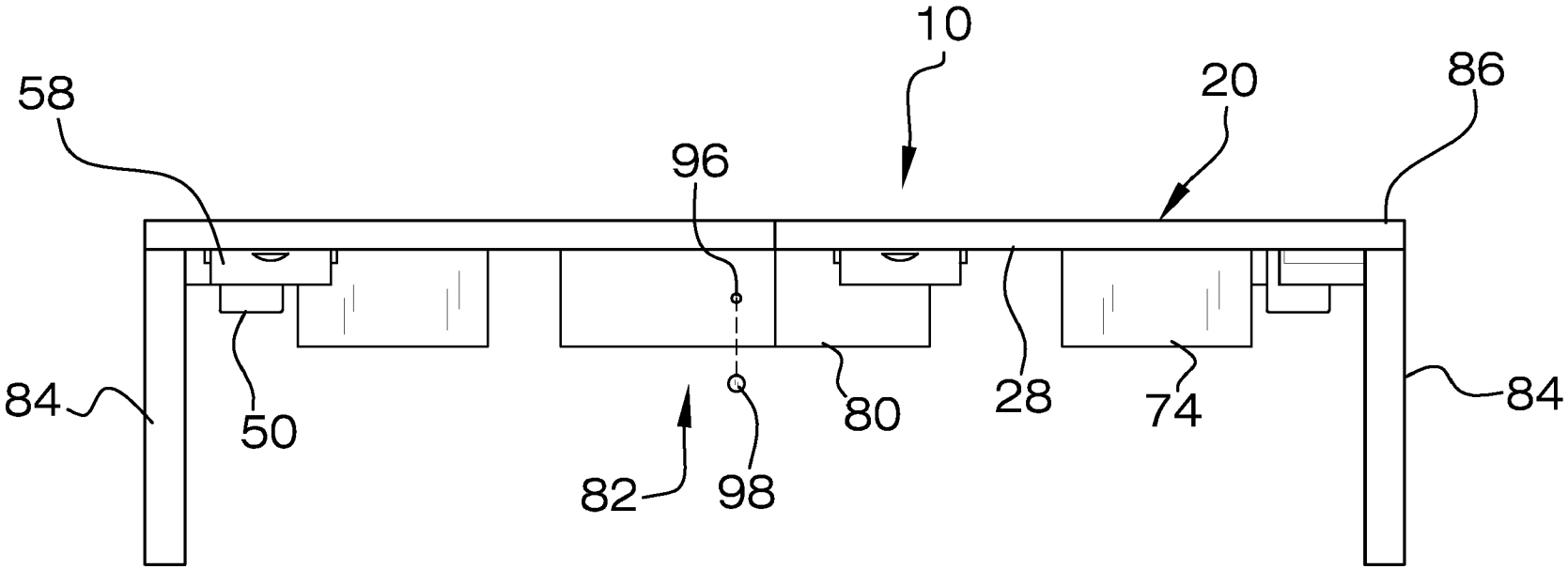
FIG. 4 is a side elevation view.
Figure 5:
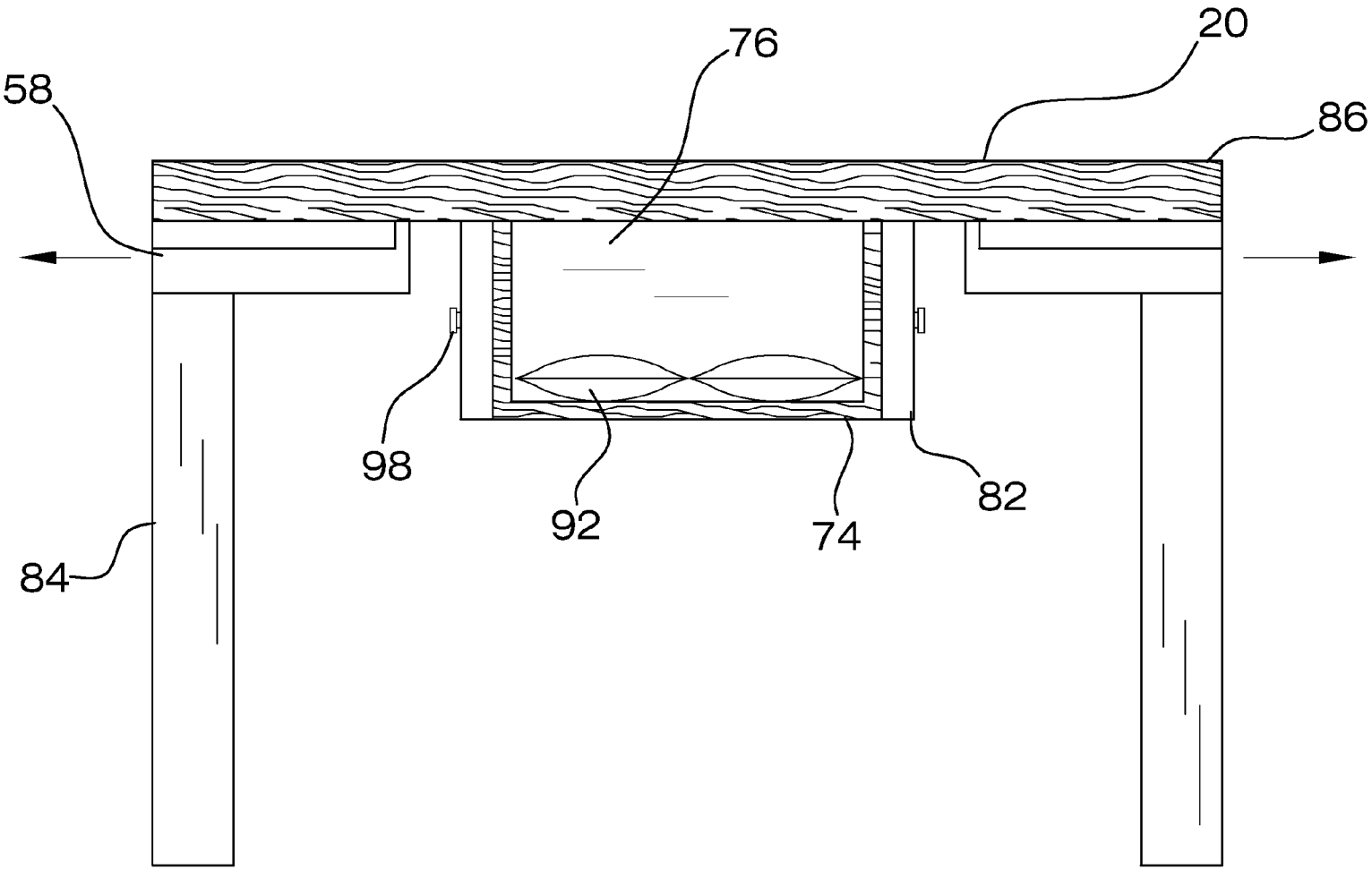
FIG. 5 is a cross-sectional view taken along line 5-5 of FIG. 3.
Figure 6:
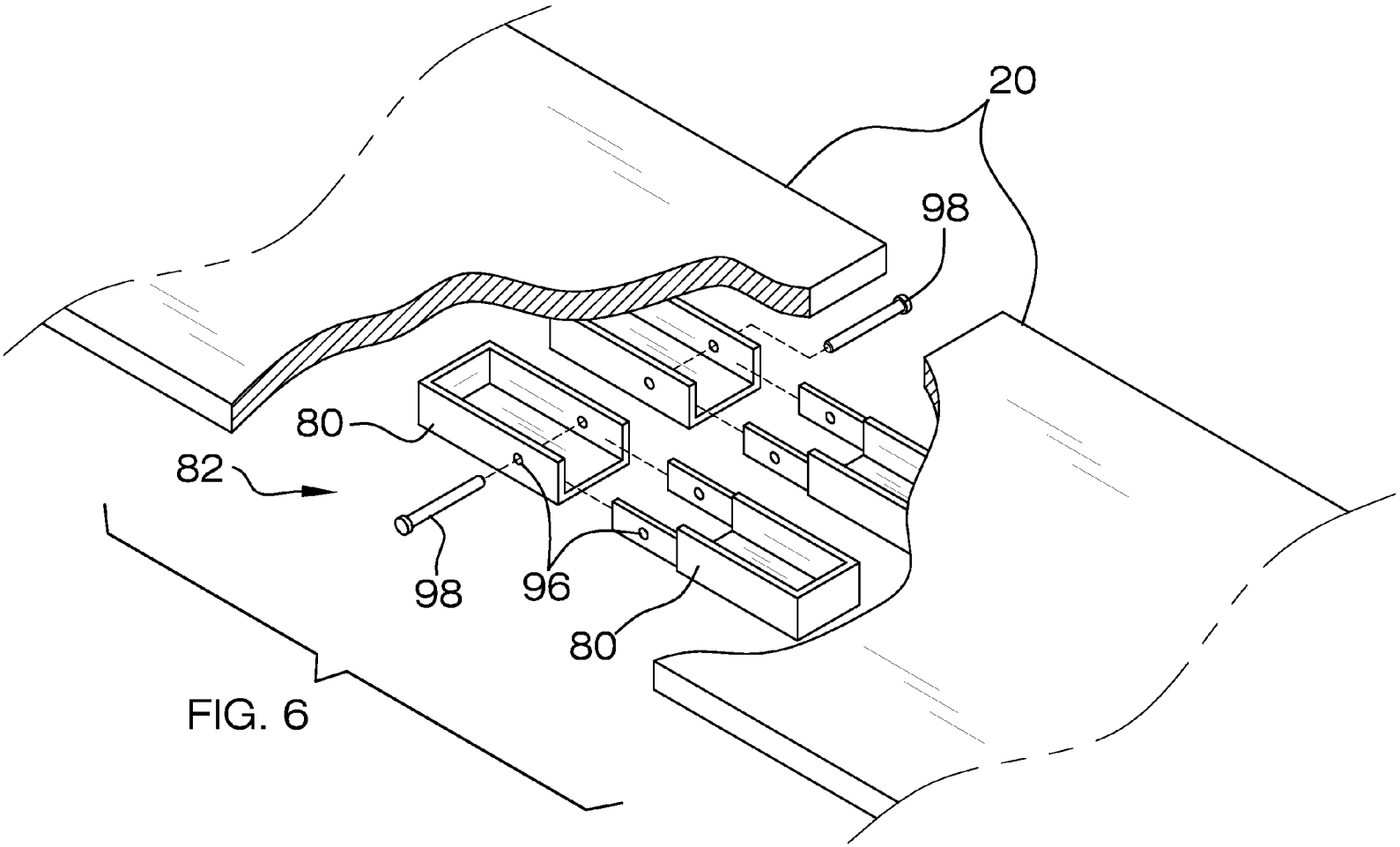
FIG. 6 is a detail view of a pinhole system.

With reference now to the drawings, and in particular FIGS. 1 through 6 thereof, example of the instant multi-purpose table employing the principles and concepts of the present multi-purpose table and generally designated by the reference number 10 will be described.

Referring to FIGS. 1 through 6 a preferred embodiment of the present multi-purpose table 10 is illustrated. The multi-purpose table 10 is a coffee table that accommodates various games, including poker and bean bag toss games. The multi-purpose table 10 includes a table 20 having a first half 22 and a second half 24. Each of the first half 22 and the second half 24 have a top surface 26, a bottom surface 28, an outer edge 30, an inner edge 32, a front surface 34, and a rear surface 36. The inner edges 32 of the each of the first half 22 and the second half 24 continuously separably adjoin. The separation capability of the first half 22 from the second half 24 allows the multi-purpose table 10 to be more compactly stored than would be the case if the table 20 were formed as a single-piece. When the first half 22 and the second half 24 are separated, the inner edge 32 of each of the first 22 and second 24 halves rests proximal the ground, and the top surface 26 of each of the first 22 and second 24 halves is thereby oriented as a slope. The top surface 26 of each of first half 22 and the second half 24 is then useable as a target in the bean bag toss game.

A circular aperture 38, which has a side wall 40, is disposed proximal to the outer edge 30 of each of the first half 22 and the second half 24. A ledge 42 is continuously disposed along a bottom edge 44 of the side wall 40. A semi-circular notch 46 is disposed on an upper perimeter 48 of each aperture 28. The notch 46 is sized to removably receive a finger therethrough. A cup 50 is removably secured within each aperture 38. Each cup 50 has a first internal cavity 52 therein and a continuous upper edge 54. The upper edge 54 is removably disposed atop the ledge 42 this preventing the cup 50 from falling through the aperture 38. The notch 46 allows a user to lift the cup 50 from the aperture 38. A disc-shaped cover 56 removably entirely covers each first internal cavity 52. Each cup 50 may hold various items such as a television remote control 93, a pen 94, or bean bags 92.

A plurality of pull-out drawers 58 is slidingly disposed on the bottom surface 28 of each of the table 20 first half 22 and the table 20 second half 24. The drawers 58 include a first drawer 61, a second drawer 62, a third drawer 63, a fourth drawer 64, a fifth drawer 65, and a sixth drawer 66. A pair of circular holes 68 is disposed through each drawer 68 proximal to a front edge 70 of the drawer 68. Each circular hole 68 removably receives a cup (not shown) therethrough. A plurality of horizontally aligned slots 72 is disposed within each drawer 58. The slots 72 removably receive poker chips 90 therein. The slots 72 may be configured in three rows as shown to hold a sufficient number of poker chips 90 and to organize the poker chips 90 by denomination.

A compartment 74 is centrally disposed on the bottom surface 28 of each of the table 20 first half 22 and the table 20 second half 24. Each compartment 74 has a second cavity 76 therethrough, which terminates at an inside edge 78 of each compartment 74. Each compartment 74 is sized to hold at least four bean bag toss game bean bags 92. The compartment 74 size allows users to store enough bean bags for properly playing a bean bag toss game.

A pair of parallel U-shaped support members 80 is continuously centrally disposed along a central horizontal axis of the bottom surface 28. The U-shaped support members 80 support both the table 20 first half 22 and the table 20 second half 24. Each of the support members 80 have a pinhole system 82 that removably conjoins the first half 22 and the second half 24 of the table 20. The pinhole system 82 includes a plurality of holes 96 disposed upon each of the pair of U-shaped support members 80. The pair of U-shaped support members 80 slidingly interconnect, and the plurality of holes 96 on each of the pair of support members 80 superimpose. At least two pins 98 releasably insert into the plurality of holes 96 and releasably secure the pair of U-shaped support members 80 together. The inner edges 32 of the first 22 and second 24 halves of the multi-purpose table 10 are held in contact when the pins 98 are releasably inserted into the plurality of holes 96.

A leg 84 is attached to the bottom surface 28 at each corner 86 of the table 20. The first drawer 61 is disposed proximal to the front surface 34 and the inner edge 32 of the table 20 second half 24. The second drawer 62 is disposed proximal to the front surface 34 and the outer edge 30 of the table 20 first half 22. The third drawer 63 is disposed proximal to the rear surface 36 and the outer edge 30 of the table 20 first half 22. The fourth drawer 64 is disposed proximal to the rear surface 36 and the inner edge 32 of the table 20 first half 22. The fifth drawer 65 is disposed proximal to the rear surface 36 and the outer edge 30 of the table 20 second half 24. The sixth drawer 66 is disposed proximal to the front surface 34 and the outer edge 30 of the table 20 second half 24.

The table 20 has a width of approximately 24 inches, a total length of approximately 70 inches, and a total height of approximately 17 inches. Each of the apertures 38 has a diameter of approximately 6 inches. Each of the drawers 58 has a length of approximately 6.5 inches and a width of approximately 6.5 inches. Each leg 84 has a length of approximately 16 inches. Each of the U-shaped support members 80 has a length of approximately 12 inches, a width of approximately 6 inches and height of approximately 3 inches. Each of the compartments 74 has a length of approximately 10 inches, a width of approximately 8 inches and a height of approximately 6 inches. The foregoing dimensions support proper use of the apparatus 10 as a coffee table which is used for playing the games mentioned herein.

With respect to the above description then, it is to be realized that the optimum dimensional relationships for the parts of the present multi-purpose table to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A multi-purpose table comprising:

a table having a first half and a second half, each of the first half and the second half having a top surface, a bottom surface, an outer edge, an inner edge, a front surface, and a rear surface, the inner edges of the each of the first half and the second half continuously separably adjoined;

a circular aperture disposed proximal to the outer edge of each of the first half and the second half, the aperture having a side wall;

a ledge continuously disposed along a bottom edge of the side wall;

a cut-out disposed on an upper perimeter of each aperture;

a cup removably secured within each aperture, the cup having a first internal cavity therein and a continuous upper edge, the upper edge removably disposed atop the ledge;

a disc-shaped cover removably covering each first internal cavity;

a plurality of pull-out drawers slidingly disposed on the bottom surface of each of the table first half and the table second half;

a pair of circular holes disposed through each drawer proximal to a front edge of the drawer;

a plurality of horizontally aligned slots disposed within each drawer, the slots removably receiving a plurality of poker chips therein;

a compartment centrally disposed on the bottom surface of each of the table first half and the table second half, each compartment having a second cavity therethrough, the second cavity terminating at an inside edge of each compartment;

a pair of parallel U-shaped support members continuously centrally disposed along a central horizontal axis of the bottom surface, the U-shaped support members supporting both the table first half and the table second half, each of the support members having a pinhole system, the pinhole system comprising:

a plurality of holes disposed on each of the pair of U-shaped support members;

a plurality of pins releasably insertable into each of the plurality of holes wherein the first half and the second half are alternately joinable and separable, each of the pair of U-shaped support members slidingly engageable to releasably secure the first half and the second half together;

a leg attached to the bottom surface at each corner of the table;

wherein the first half and the second half are separable and independently positionable, the inner edge of each of the first half and the second half are disposed proximal to the ground, the top surface of each of the first half and the second half oriented along a plane disposed in an acute angle relative to the ground, whereby the top surface of each of the first half and the second half are transformed into a target configured to receive a plurality of bean bags; and wherein the top surface of each of the first half and the second half are aligned in a common plane when the pair of U-shaped support members are slidingly engaged and releasably secured by means of the plurality of pins, whereby a single surface is formed in a horizontal plane configured to play a card game thereon.

2. A multi-purpose table consisting of:

a table having a first half and a second half, each of the first half and the second half having a top surface, a bottom surface, an outer edge, an inner edge, a front surface, and a rear surface, the inner edges of the each of the first half and the second half continuously separably adjoined;

a circular aperture disposed proximal to the outer edge of each of the first half and the second half, the aperture having a side wall;

a ledge continuously disposed along a bottom edge of the side wall;

a cut-out disposed on an upper perimeter of each aperture, the cut-out sized to removably receive a finger therethrough;

a cup removably secured within each aperture, the cup having a first internal cavity therein and a continuous upper edge, the upper edge removably disposed atop the ledge;

a disc-shaped cover removably covering each first internal cavity;

a plurality of pull-out drawers slidingly disposed on the bottom surface of each of the table first half and the table second half, the drawers consisting of a first drawer, a second drawer, a third drawer, a fourth drawer, a fifth drawer, and a sixth drawer;

a pair of circular holes disposed through each drawer proximal to a front edge of the drawer, each circular hole removably receiving a cup therethrough;

a plurality of horizontally aligned slots disposed within each drawer, the slots removably receiving a plurality of poker chips therein;

a compartment centrally disposed on the bottom surface of each of the table first half and the table second half, each compartment having a second cavity therethrough, the second cavity terminating at an inside edge of each compartment, each compartment sized to hold at least four bean bag toss game bean bags;

a pair of parallel U-shaped support members continuously centrally disposed along a central horizontal axis of the bottom surface, the U-shaped support members supporting both the table first half and the table second half, each of the support members having a pinhole system, the pinhole system comprising:

a plurality of holes disposed on each of the pair of U-shaped support members;

a plurality of pins releasably insertable into each of the plurality of holes wherein the first half and the second half are alternately joinable and separable, each of the pair of U-shaped support members slidingly engageable to releasably secure the first half and the second half together;

a leg attached to the bottom surface at each corner of the table;

wherein the first half and the second half are separable and independently positionable, the inner edge of each of the first half and the second half are disposed proximal to the ground, the top surface of each of the first half and the second half oriented along a plane disposed in an acute angle relative to the ground, whereby the top surface of each of the first half and the second half are transformed into a target configured to receive the bean bags;

wherein the top surface of each of the first half and the second half are aligned in a common plane when the pair of U-shaped support members are slidingly engaged and releasably secured by means of the plurality of pins, whereby a single surface is formed in a horizontal plane configured to play a card game thereon;

wherein the first drawer is disposed proximal to the front surface and the inner edge of the table second half;

wherein the second drawer is disposed proximal to the front surface and the outer edge of the table first half;

wherein the third drawer is disposed proximal to the rear surface and the outer edge of the table first half;

wherein the fourth drawer is disposed proximal to the rear surface and the inner edge of the table first half;

wherein the fifth drawer is disposed proximal to the rear surface and the outer edge of the table second half; and wherein the sixth drawer is disposed proximal to the front surface and the outer edge of the table second half.

3. A multi-purpose table consisting of:

a table having a first half and a second half, each of the first half and the second half having a top surface, a bottom surface, an outer edge, an inner edge, a front surface, and a rear surface, the inner edges of the each of the first half and the second half continuously separably adjoined;

a circular aperture disposed proximal to the outer edge of each of the first half and the second half, the aperture having a side wall;

a ledge continuously disposed along a bottom edge of the side wall;

a cut-out disposed on an upper perimeter of each aperture, the cut-out sized to removably receive a finger therethrough;

a cup removably secured within each aperture, the cup having a first internal cavity therein and a continuous upper edge, the upper edge removably disposed atop the ledge;

a disc-shaped cover removably covering each first internal cavity;

a plurality of pull-out drawers slidingly disposed on the bottom surface of each of the table first half and the table second half, the drawers consisting of a first drawer, a second drawer, a third drawer, a fourth drawer, a fifth drawer, and a sixth drawer;

a pair of circular holes disposed through each drawer proximal to a front edge of the drawer, each circular hole removably receiving a cup therethrough;

a plurality of horizontally aligned slots disposed within each drawer, the slots removably receiving a plurality of poker chips therein, wherein the slots are configured in three parallel rows;

a compartment centrally disposed on the bottom surface of each of the table first half and the table second half, each compartment having a second cavity therethrough, the second cavity terminating at an inside edge of each compartment, each compartment sized to hold at least four bean bag toss game bean bags;

a pair of parallel U-shaped support members continuously centrally disposed along a central horizontal axis of the bottom surface, the U-shaped support members supporting both the table first half and the table second half, each of the support members having a pinhole system, the pinhole system comprising:

a plurality of holes disposed on each of the pair of U-shaped support members;

a plurality of pins releasably insertable into each of the plurality of holes;

wherein the first half and the second half are alternately joinable and separable, each of the pair of U-shaped support members slidingly engageable to releasably secure the first half and the second half together;

a leg attached to the bottom surface at each corner of the table;

wherein the first half and the second half are separable and independently positionable, the inner edge of each of the first half and the second half are disposed proximal to the ground, the top surface of each of the first half and the second half oriented along a plane disposed in an acute angle relative to the ground, whereby the top surface of each of the first half and the second half are transformed into a target configured to receive a plurality of bean bags;

wherein the top surface of each of the first half and the second half are aligned in a common plane when the pair of U-shaped support members are slidingly engaged and releasably secured by means of the plurality of pins, whereby a single surface is formed in a horizontal plane configured to play a card game thereon;

wherein the first drawer is disposed proximal to the front surface and the inner edge of the table second half;

wherein the second drawer is disposed proximal to the front surface and the outer edge of the table first half;

wherein the third drawer is disposed proximal to the rear surface and the outer edge of the table first half;

wherein the fourth drawer is disposed proximal to the rear surface and the inner edge of the table first half;

wherein the fifth drawer is disposed proximal to the rear surface and the outer edge of the table second half;

wherein the sixth drawer is disposed proximal to the front surface and the outer edge of the table second half;

wherein the table has a width of approximately 24 inches, a total length of approximately 70 inches, and a total height of approximately 17 inches;

wherein each of the apertures has a diameter of approximately 6 inches;

wherein each of the drawers has a length of approximately 6.5 inches and a width of approximately 6.5 inches;

wherein each leg has a length of approximately 16 inches;

wherein each of the U-shaped support members has a length of approximately 12 inches, a width of approximately 6 inches and height of approximately 3 inches;

wherein each of the compartments has a length of approximately 10 inches, a width of approximately 8 inches and a height of approximately 6 inches.

* * * * *